United States Patent [19]

Paquette

[11] 4,013,257

[45] Mar. 22, 1977

[54] CHAIR CONTROL

[75] Inventor: Kenneth N. Paquette, Muskegon, Mich.

[73] Assignee: The Shaw-Walker Company,. Muskegon, Mich.

[22] Filed: Mar. 3, 1976

[21] Appl. No.: 663,299

Related U.S. Application Data

[63] Continuation of Ser. No. 569,110, April 17, 1975, abandoned.

[52] U.S. Cl. ..... 248/379; 297/304

[51] Int. Cl.[2] ..... A45D 19/04

[58] Field of Search ..... 248/372, 378–382, 248/384; 297/300–306

[56] References Cited

UNITED STATES PATENTS

| | | | |
|---|---|---|---|
| 2,498,106 | 2/1950 | Elleman | 297/301 |
| 2,650,646 | 9/1953 | Herold et al. | 297/301 |
| 3,881,772 | 5/1975 | Mohrman | 297/300 |

*Primary Examiner*—James C. Mitchell
*Attorney, Agent, or Firm*—Kinzer, Plyer, Dorn & McEachran

[57] ABSTRACT

A chair control, having a basic mechanism which can be modified slightly for use in swivel tilt, stenographer's and double action posture chairs. The basic chair control mechanism includes a pair of chair seat supporting arms, a screw post cap which mounts on a chair screw post or a lifting cylinder and a spring housing. The spring housing is pivotally connected at its front end to the screw post cap so that the housing can rotate about a generally horizontal axis. Compression springs are carried in the spring housing and engage an adjustably movable wall at the rear end of the housing. A spring retaining member pivotally mounted on the screw post cap for rotation about a horizontal axis engages the front ends of the springs and is biased for upward rotation by said springs. A pivot pin slidably connects the spring housing and the spring retaining member so that when the spring housing is rotated by tilting of the chair, the spring housing rotates about its pivotal connection to the screw post cap and rotates the spring retaining member about its pivotal mounting, thereby maintaining the spring retaining member in its normal position of engagement with the springs. When used with a swivel tilt chair, i.e. a chair in which the seat and back tilt together, the seat supporting arms are fixed to the spring housing. When used with a stenographer's chair, i.e. a chair in which the seat is fixed horizontally and the chair back tilts relative thereto, the seat supporting arms are fixed to the screw post cap. When the chair control is used with a double action posture chair, i.e. a chair in which the seat and back both tilt relative to the screw post, but through different angles, the chair seat supporting arms are pivotally connected to the screw post cap and slidably mounted relative to the spring housing.

13 Claims, 12 Drawing Figures

CHAIR CONTROL

This is a continuation of application Ser. No. 569,110 filed April 17, 1975 now abandoned.

SUMMARY OF THE INVENTION

This invention is directed to a chair control mechanism for office type chairs and more particularly to a control mechanism for office type chairs which are tilted.

An object of this invention is a modular chair control mechanism of simplified and compact construction having interchangeable components which can be used with slight modifications for a family of swivel tilt chairs, stenographer's chairs, and double action posture chairs.

An object of this invention is a chair control mechanism having its bulk located behind the screw post of the chair.

Another object is a chair control mechanism sufficiently compact to be concealed by a decorative outer shell of a modern shell type office chair.

Another object is a chair control mechanism in which the spring tension adjustment is located at the back of the chair.

Another object is a chair control mechanism which can easily utilize large capacity compression springs.

Another object is a chair mechanism in which the spring deflection rate is almost constant throughout the angle of tilt of the chair.

Another object is a chair control mechanism for a double action posture chair in which the pivotal axis of the seat support arms is located well forward on the seat to minimize lifting of the front edge of the seat during tilting of the back.

Another object is to mount the chair back support bar in the spring housing.

Other objects may be found in the following specification, claims and drawings.

BRIEF DESCRIPTION OF THE DRAWINGS

The invention is illustrated more or less diagramatically in the following drawings wherein.

DESCRIPTION OF THE PREFERRED EMBODIMENTS

Figure 1:
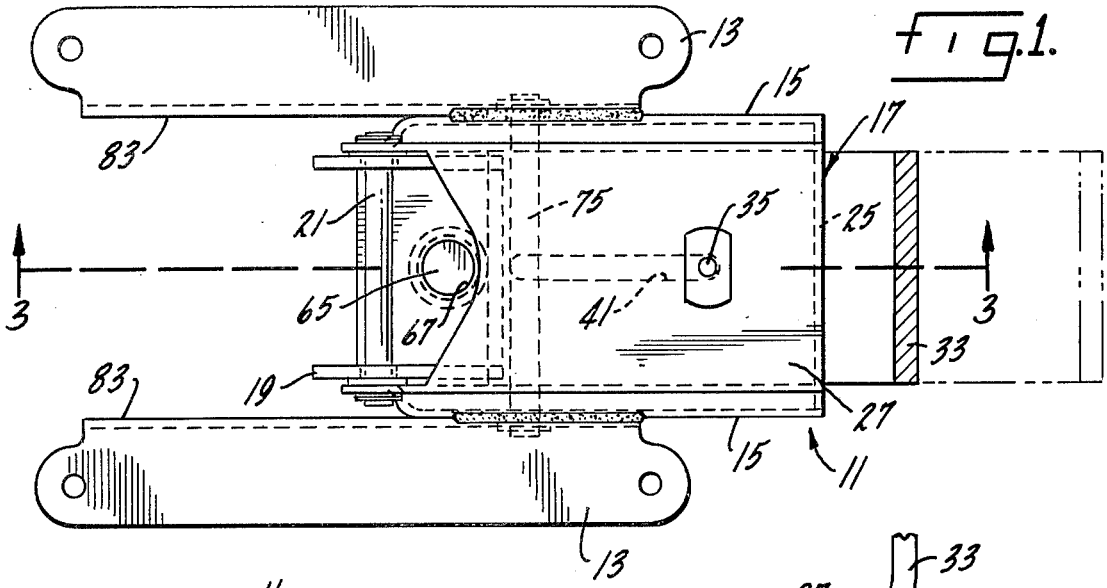
FIG. 1 is a top plan view of one embodiment of chair control mechanism of this invention adapted for use with a swivel chair of the type in which the back and seat tilt together.
Figure 2:
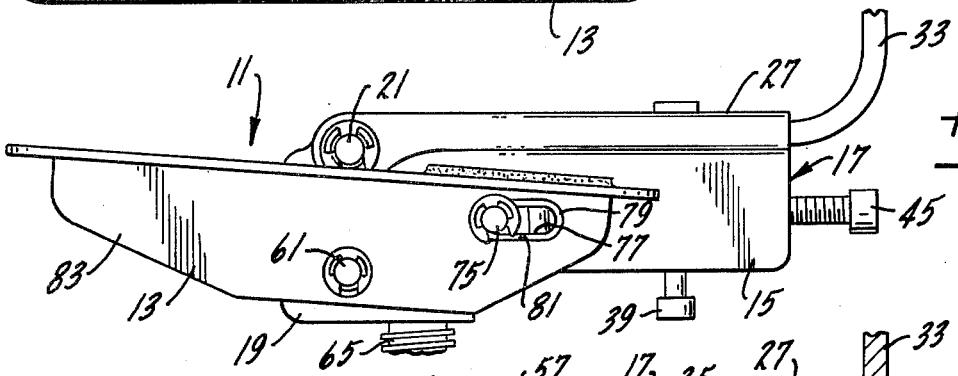
FIG 2 is a side elevational view of the mechanism of FIG. 1.

One form of chair control mechanism 11 embodying the novel aspects of this invention is shown in FIGS. 1 through 4 of the drawings. Chair control mechanism 11 is adapted for use with what are called swivel tilt chairs. These are chairs in which the seat and back are fastened to each other so that they rotate and tilt together. The mechanism 11 includes seat support arms 13 which are fastened to and support the underside of a chair seat, which is not shown in these drawings for clarity of illustration. The seat support arms are fastened, in this case by welding, to the depending side walls 15 of a spring housing 17. The front of the spring housing is pivotally connected to a screw post cap 19 for rotation about a horizontal axis by means of a pivot pin 21 which extends through openings in the side walls 15 of the spring housing and in the walls of the screw post cap. The pivot pin is held in position by conventional locking means such as crescent shaped locking washers which fit in grooves cut in the pivot pin near the ends thereof. Other methods of holding the pivot pin in place, such as flattening one end of a headed pin may also be employed. Bushings formed of materials with low friction characteristics may be provided between the pivot pin and the side walls of the spring housing and screw post cap to reduce friction.

The rear of the spring housing 17 is closed by a wall 25 which terminates short of the top wall 27 of the housing. This end wall includes an integral tab 29 which is bent at right angles thereto and extends parallel to the top wall 27 and towards the front of the spring housing. This tab is located below the top wall 27 of the spring housing, thus forming a slot 31 which receives a movable chair back support bracket 33. A threaded opening 35 is provided in the top wall 27 of the housing and an elongated slot 37 is formed in the tab 29 in alignment with the opening 35. A threaded bolt 39 extends through the slot 37 in the tab and through an elongated slot 41 formed in the support bracket 33 and threads into the opening 35 to hold the back support bracket 33 in a selected one of a variety of positions of adjustment.

A movable wall 43 is positioned in the spring housing 17 and is guided by the tab 29. A cap screw 45 extends through a threaded opening 47 in the end wall 25 and the tip of this cap screw seats in a boss 49 formed in the movable wall. A reinforcing member 51 fits over the cap screw and is located between the movable wall 43 and the end wall 25 of the spring housing.

A pair of coiled compression springs 55 are positioned in side by side relationship in the spring housing 17 with one set of ends of the springs engaging the movable wall 43. The opposite ends of the springs engage a base portion 57 of a U-shaped spring retaining member 59 which is located at the forward end of the spring housing. The spring retaining member 59 is pivotally mounted to the screw post cap 19 for rotation about a horizontal axis by a pivot pin 61 which extends through openings formed in the legs 63 of this member near the open end of the U. The pivot pin 61 is held in position by crescent shaped clips which fit into grooves cut in the ends of the pivot pin. Low friction bushings or bearings may be provided between the pivot pin 61 and the legs 63 of the spring retaining member 59 to reduce friction during rotation.

It should be noted that the pivot pin 61 of the spring retaining member is located below the pivot pin 21 of the spring housing 17 and in vertical alignment therewith. Both of these pivot pins are located on the front side of the chair screw post 65 while the springs 55 are positioned in the spring housing 17 on the rear side thereof. As is conventional, the chair screw post 65 has a tapered upper end portion which fits into an upper circular opening 67 and a larger lower circular opening 69 which are formed in the screw post cap 19. This construction is referred to as a demountable chair post in the industry. It should be understood that a lifting cylinder may be used in place of the demountable chair post.

The spring housing 17 and the spring retaining member 59 are operatively connected together by means of a pivot pin 75 which is fixed relative to the spring retaining member and is guided for movement in slots 77 cut in the side walls 15 of the spring housing. The pivot pin 75 extends through circular openings formed in the legs 63 of the spring retaining member near the base portion 57 thereof. Suitable bushings are provided where the pivot pin extends through the legs of the spring retaining member to reduce rotational friction of the pin relative to the spring retaining member. Bushings 79 are also provided in the slots 77 to reduce the sliding friction of pin 75 relative to the spring housing. The pivot pin 75 may be held in position by crescent shaped locking rings which fit into grooves cut in the ends of the pivot pin or may be fastened in any other suitable manner. The pivot pin 75 also extends through clearance slots 81 formed in the downwardly extending portions 83 of the seat support arms 13. The pivot pin 75 which connects the spring housing 17 and the spring retaining member 59 is positioned on the opposite side of the chair screw post 65 from the pivot pins 21 and 61.

Figure 3:
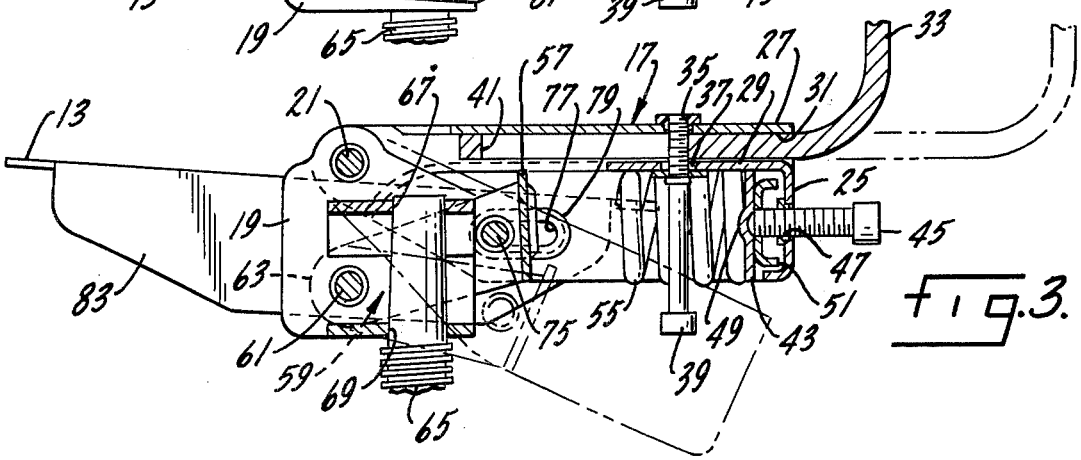
FIG. 3 is a cross-sectional view taken along line 3—3 of FIG. 1.
Figure 4:
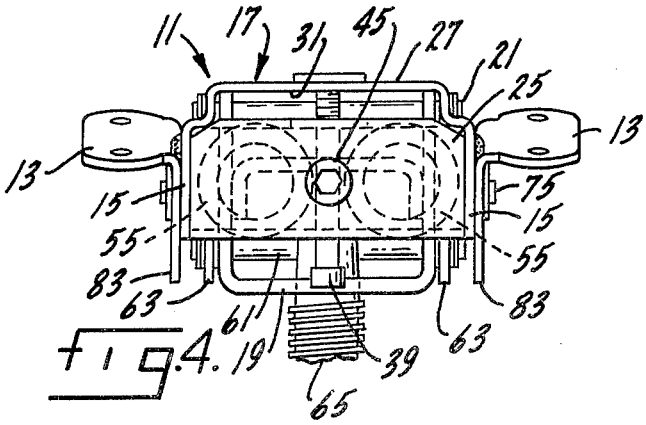
FIG. 4 is an end elevational view of the mechanism of FIG. 1.
Figure 5:
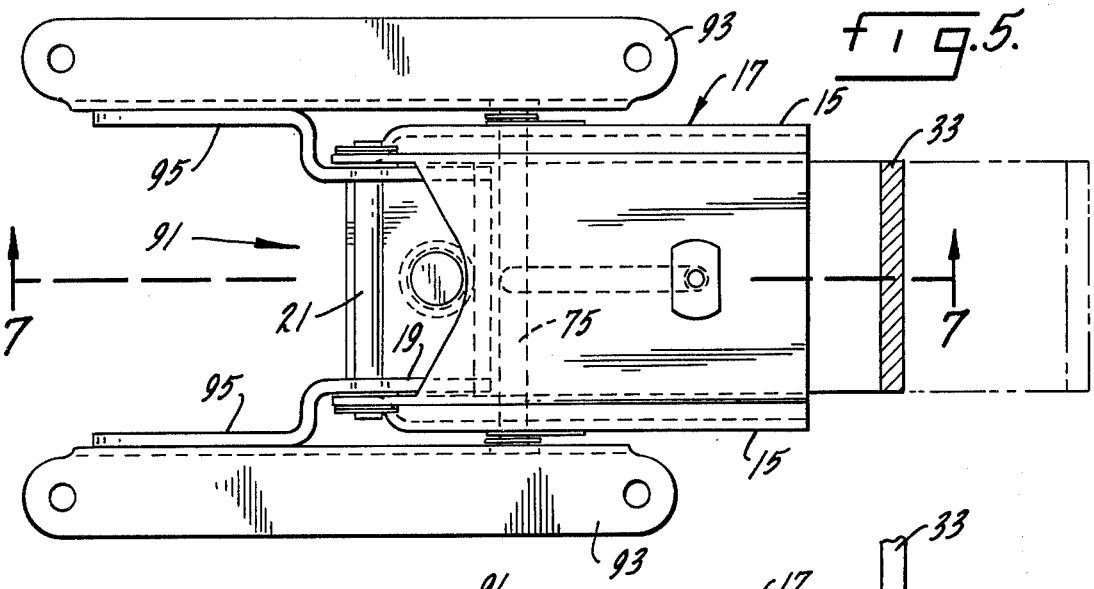
FIG. 5 is a top plan view of another embodiment of a chair control mechanism adapted for use with a stenographic chair of the type in which the seat is fixed horizontally and the back tilts relative to the seat.
Figure 6:
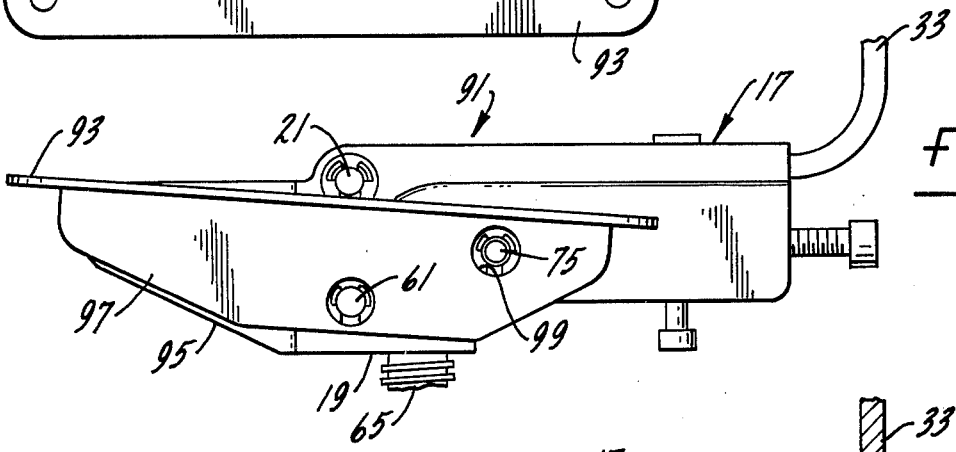
FIG. 6 is a side elevational view of the mechanism of FIG. 5.
Figure 7:
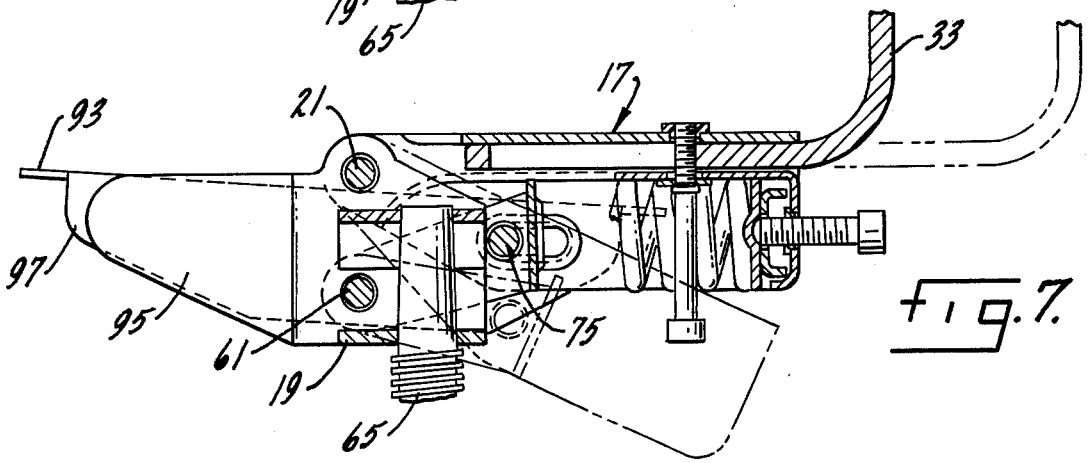
FIG. 7 is a cross-sectional view taken along line 7—7 of FIG. 5.
Figure 8:
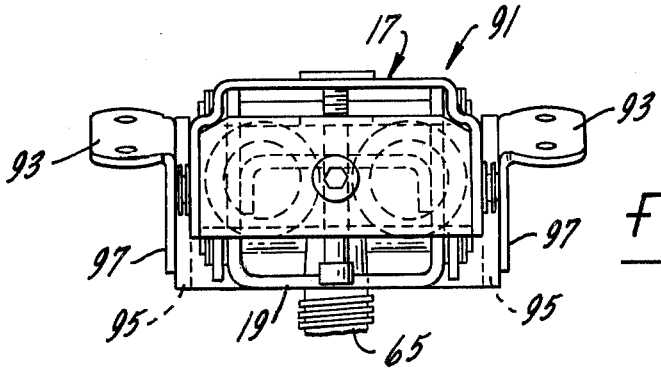
FIG. 8 is an end elevational view of the mechanism of FIG. 5.
Figure 9:
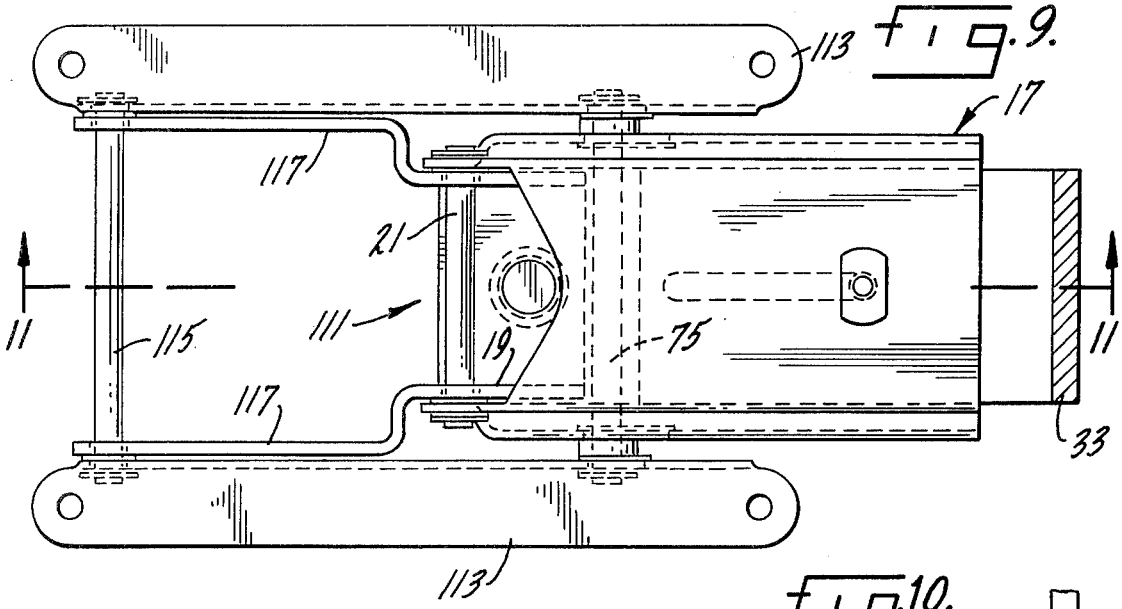
FIG. 9 is a top plan view of yet another embodiment of a chair control mechanism adapted for use with a posture chair of the type in which the seat and back of the chair tilt relative to the screw post but through different angles.
Figure 10:
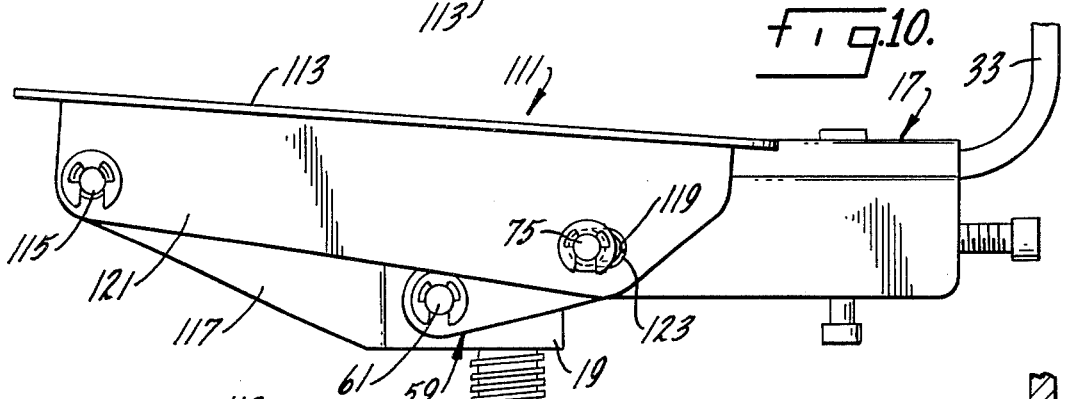
FIG. 10 is a side elevational view of the mechanism of FIG. 9.
Figure 11:
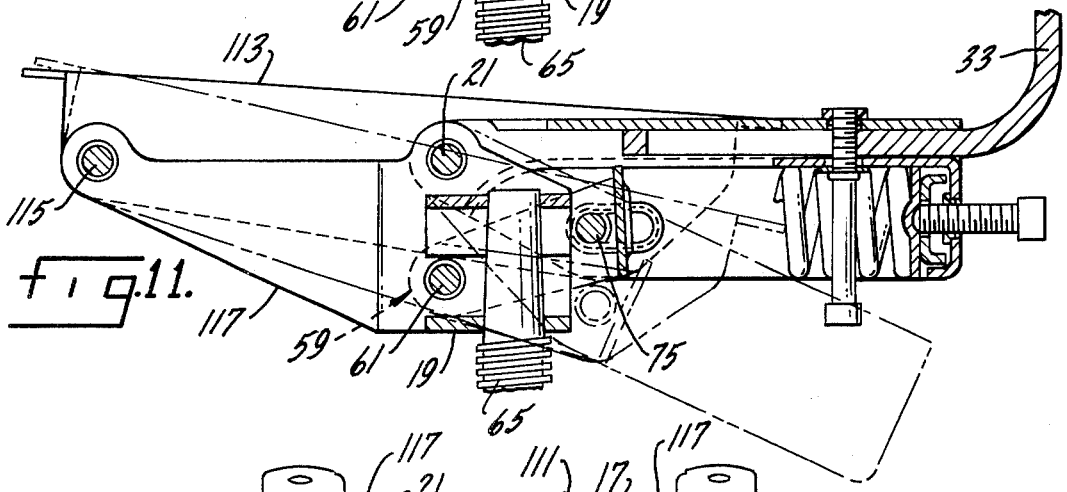
FIG. 11 is a cross-sectional view taken along line 11—11 of FIG. 10.
Figure 12:
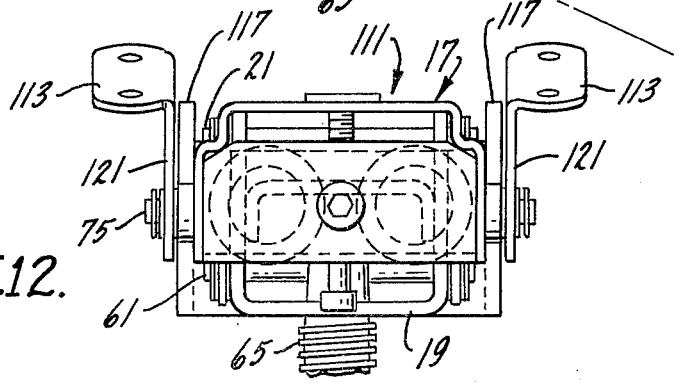
FIG. 12 is an end elevational view of the mechanism of FIG. 9.

When the chair control mechanism 11 is in its "unloaded"position, that is the position shown in solid lines in FIG. 3 of drawings and which occurs when there is no seating load on the chair, the force exerted by the compression springs 55 against the spring retaining member 59 acts in a direction which causes the spring retaining member and its captive pivot pin 75 to rotate in a counterclockwise and upward direction, as viewed in FIG. 3, about the pivot pin 61. Thus, the compression springs bias the chair seat towards a horizontal or non-tilted position. The amount of force exerted by the compression springs can be varied by rotational adjustment of the cap screw 45 which moves the wall 43 to compress or release compression of the springs. In the chair control mechanism shown in FIGS. 1 through 4 of the drawings, the maximum inclination or tilting of the spring housing 17 is to a position approximately 24° below the horizontal, which position is shown in phantom lines in FIG. 3. Tilting of the spring housing 17 compresses the springs 55 thereby increasing the force exerted against the spring retaining member 59. However, as the spring housing tilts, the effective moment arm of the spring force relative to the pivot pin 61 is reduced. As a consequence, the effective force acting to rotate the spring retaining member 59 and the spring housing 17 back to the horizontal position of the chair seat remains more or less constant during tilting of the chair seat.

A second embodiment of chair control mechanism 91 constructed in accordance with the teachings of this invention is shown in FIGS. 5 through 8 of the drawings. The chair control mechanism 91 is especially adapted for use with what are called stenographer's chairs. These are chairs in which the seat is fastened to the screw post cap 19, and the chair back tilts relative to the seat and the screw post cap. This chair control mechanism is similar to the chair control mechanism 11 shown in FIGS. 1 through 4 of the drawings and contains the same basic components as the previously described chair control mechanism 11 except for the differences which will be hereinafter described. As has been previously mentioned, one advantage of the chair control mechanisms of this invention is that the same basic components may be used with slight modifications for different types of chairs. In this embodiment of the invention, the only substantial change from the chair control mechanism 11 is that the seat support arms 93 are fastened, preferably by welding, to integral forward extensions 95 of the screw post cap 19. Thus, the seat support arms and the seat which attaches thereto are fixed relative to the screw post cap. Since the spring housing 17 rotates about a horizontal axis relative to the chair support arms 93, the pivot pin 75 which moves with the spring housing is modified so that it does not extend into the depending portions 97 of the seat support arms. However, circular openings 99 are provided in the depending portions of these arms to allow insertion and removal of the pin 75 through the seat support arms. All of the other components of the chair control member 91 are similar to those of the chair control mechanism 11.

The third form of chair control mechanism embodying the novel features of this invention is shown in FIGS. 9 through 12 of the drawings. Chair control mechanism 111 shown therein is adapted for use with what are called double action posture chairs. These are chairs in which the seat and back tilt relative to the screw post but through different angles of rotation. In a chair of this type, the back will tilt through an angle 3 or 4 times greater than the angle of tilt of the seat during the same tilting movement of the occupant of the chair. The mechanism 111 includes seat support arms 113 which are mounted on a pivot pin 115 for pivotal rotation relative to the screw post cap 19. The pivot pin 115 is journalled in forwardly projecting extensions 117 which are welded to the screw post cap 19. As is shown in the drawings, the pivotal connection of the seat support arms 113 to the screw post cap extension 117 is located well in front of the screw post cap 19. This pivotal connection is located about one third of the distance from the front edge of the seat. This minimizes the lifting of the front edge of the seat when the back is tilted. Excess lifting of the front edge of the chair is undesirable since it cuts off circulation in the legs of the occupant. The chair seat support arms are also pivotally and slidably connected to the pivot pin 75 which connects the spring housing 17 and spring retaining member 59. The pivot pin 75 rides in elongated slots 119 formed in the depending portions 121 of the seat support arms 113. Suitable bushings 123 are provided in the slots 119 to reduce friction. The other parts of the chair control mechanism 111 are similar to those found in the chair control mechanisms 11 and 91. When the back of the chair is tilted, the chair seat support arms 113 will move through an angle of approximately 8° while the spring housing 17 is moving through an angle of 24° thereby providing a one to three ratio between the tilt of the chair seat and the tilt of the chair back.

Whereas several preferred embodiments of the invention have been shown and described, it should be understood that there are many modifications, changes and alterations which may be made to these embodiments without departing from the scope and spirit of the invention. Therefore, the scope of this invention should be limited only by a liberal interpretation of the claims attached hereto.

I claim:

1. A chair control including:

a pair of chair seat supporting arms, a post cap adapted to be mounted on a chair post, a spring housing pivotally connected at one end thereof to said post cap for rotation about a generally horizontal axis, at least one compression spring positioned in said spring housing and engaging a wall of said housing located at the end of the housing away from said pivotal connection, a spring retaining member engaging the opposite end of said spring with said member pivotally mounted on said post cap for rotation about a generally horizontal axis and said spring biasing said member in an upward direction, and means connecting said spring housing and said spring retaining member so that rotation of said spring housing about its pivotal connection to said post cap will bring about rotation of said spring retaining member about its pivotal mounting to said post cap.

2. The chair control of claim 1 in which the pivotal connection of said spring housing to said post is located above and in vertical alignment with the pivotal mounting of said spring retaining member of said post cap.

3. The chair control of claim 1 in which the wall of said housing located at the end of said housing away from said pivotal connection is movable to vary the amount of compression of said spring.

4. The chair control of claim 1 in which said means connecting said spring retaining member and said spring housing includes a pivot pin journalled in said spring retaining member and guided for linear movement in elongated slots formed in said spring housing.

5. The chair control of claim 1 in which said chair seat supporting arms are affixed to said spring housing.

6. The chair control of claim 1 in which said chair seat supporting arms are affixed to said post cap.

7. The chair control of claim 1 in which said chair seat supporting arms pivotally connected to said post cap and slidably mounted relative to said spring housing.

8. The chair control of claim 2 in which the pivotal connection of the spring housing and the pivotal mounting of the spring retaining member to the chair post cap are located on one side of the chair post and the means connecting the spring housing and the spring retaining member for rotation of said spring retaining member is located on the opposite side of the chair post.

9. The chair control of claim 8 in which said means connecting said spring retaining member and said spring housing includes a pivot pin journalled in said spring retaining member and guided for linear movement in elongated slots formed in said spring housing.

10. The chair control mechanism of claim 1 in which a chair back support bracket is mounted in said spring housing and is movable between forward and rearward positions of adjustment.

11. The chair control of claim 1 in which downward rotation of said spring housing compresses said compression spring and causes downward rotation of said spring retaining member thereby reducing the effective moment arm of said spring which is biasing said spring retaining member in an upward direction.

12. A chair control including:

a pair of chair seat supporting arms, a post cap adapted to be mounted on a chair post, a spring housing pivotally connected at one end thereof to said post cap for rotation about a generally horizontal axis, at least one compression spring positioned in said spring housing and engaging a wall of said housing located at the end of the housing away from said pivotal connection, a spring retaining member engaging the opposite end of said spring with said member pivotally mounted on said post cap for rotation about a generally horizontal axis and said spring biasing said member in an upward direction, and means connecting said spring housing and said spring retaining member so that said upward bias of said spring retaining member caused by said compression spring is transferred to said spring housing to cause an upward bias thereof.

13. The chair control of claim 12 in which downward rotation of said spring housing compresses said compression spring and causes downward rotation of said spring retaining member thereby reducing the effective moment arm of said spring which is biasing said spring retaining member in an upward direction.

* * * * *